US005598629A

United States Patent [19]

Schneider et al.

[11] Patent Number: 5,598,629

[45] Date of Patent: Feb. 4, 1997

[54] PROCESS FOR MAKING CONTACT WITH A SILVER CONTACT BASE

[75] Inventors: Manfred Schneider, Lichtenfels; Dietmar Clauss, Altenkunstadt, both of Germany

[73] Assignee: Siemens Aktiengesellschaft, Munich, Germany

[21] Appl. No.: 254,128

[22] Filed: Jun. 6, 1994

Related U.S. Application Data

[63] Continuation of PCT/DE92/00998 Nov. 30, 1992.

[30] Foreign Application Priority Data

Dec. 4, 1991 [DE] Germany ..... 41 39 998.6

[51] Int. Cl.[6] ..... H01R 43/20

[52] U.S. Cl. ..... 29/879; 29/267; 29/268; 200/268

[58] Field of Search ..... 200/268, 267; 29/874, 876

[56] References Cited

U.S. PATENT DOCUMENTS

| | | | |
|---|---|---|---|
| 2,812,406 | 11/1957 | Egan | 200/268 X |
| 3,775,067 | 11/1973 | Backstrom . | |
| 4,053,728 | 10/1977 | Talento et al. | 200/267 |
| 4,138,604 | 2/1979 | Harmsen et al. . | |
| 4,342,893 | 8/1982 | Wolf . | |
| 5,421,084 | 6/1995 | Wolf et al. | 29/876 X |

FOREIGN PATENT DOCUMENTS

| | | |
|---|---|---|
| 0027893 | 5/1981 | European Pat. Off. . |
| 0283536 | 9/1988 | European Pat. Off. . |
| 0299099 | 1/1989 | European Pat. Off. . |
| 0301218 | 2/1989 | European Pat. Off. . |
| 2642338 | 2/1978 | Germany . |
| 3107665 | 9/1982 | Germany . |
| 3437981 | 8/1986 | Germany . |

*Primary Examiner*—Carl J. Arbes
*Attorney, Agent, or Firm*—Herbert L. Lerner; Laurence A. Greenberg

[57] ABSTRACT

A contact includes a silver contact base, an intermediate silver layer and a solder in the form of a platelet being provisionally fastened or tacked to the intermediate silver layer prior to an actual soldering operation. The silver contact base is soldered onto a contact carrier by the intermediate silver layer and the solder platelet. A method for making a contact includes pressing an intermediate silver layer onto a silver contact base, then provisionally fastening or tacking a solder in the form of a platelet to the intermediate silver layer and subsequently placing a contact carrier on the solder platelet and soldering the contact carrier to the solder platelet.

11 Claims, 1 Drawing Sheet

PROCESS FOR MAKING CONTACT WITH A SILVER CONTACT BASE

CROSS-REFERENCE TO RELATED APPLICATION

This application is a Continuation of International Application Ser. No. PCT/DE92/00998, filed Nov. 30, 1992.

BACKGROUND OF THE INVENTION

FIELD OF THE INVENTION

The invention relates to a contact with a silver contact base, which is soldered to a contact carrier by means of a silver intermediate layer and a solder. The invention also relates to a method for making the contact. Among other uses, such contacts are used in relays and switches of the most varied kinds.

The solders required for soldering are commercially available as flat material. They already contain metered additives as soldering aids. It is known for strips of contact solder and pure silver to be joined together by hot rolling and for flat solder material then to be rolled as a third layer onto the two-layer strip. The contacts are then cut from the resultant three-layer strip and soldered onto the contact bearers or carriers. It is a peculiarity of that production process that the rolled edges have to be trimmed, so that waste is involved. Cutting apart the contacts is also becoming increasingly problematic, if the contact thicknesses are great.

It is also known to make two-layer contacts from a silver intermediate layer which is cut to contact dimensions and from a press-on silver contact base, and then to solder those contacts onto the respective contact carrier by using a solder and soldering aids. With that mode of operation no waste is produced, as long as strip material is used that matches the width or length of the later contact at least in its width. In larger quantities, however, that mode of operation is relatively complicated, because exact positioning and metering of the solder and soldering aid is required.

SUMMARY OF THE INVENTION

It is accordingly an object of the invention to provide a contact with a silver contact base and a process for making the same, which overcome the hereinafore-mentioned disadvantages of the heretofore-known devices and methods of this general type and which simplify the production of contacts without impairing quality. In particular, the position of solder on an intermediate silver layer of a two-layer contact should continue to be reliably assured. Moreover, an upward creep of the solder on the silver contact base upon soldering to a contact carrier should be prevented.

With the foregoing and other objects in view there is provided, in accordance with the invention, a contact, comprising a silver contact base; an intermediate silver layer; and a solder in the form of a platelet being provisionally fastened or tacked to the intermediate silver layer prior to an actual soldering operation; the silver contact base being soldered onto a contact carrier by the intermediate silver layer and the solder platelet.

As a result, the solder reliably stays positioned on the intermediate silver layer without slipping or even dropping off prematurely, in other words before the contact bearer or carrier is soldered on. This creates a prerequisite for reliable manipulation of the parts to be soldered to one another.

With the objects of the invention in view, there is also provided a method for making a contact, which comprises pressing an intermediate silver layer onto a silver contact base; then provisionally fastening or tacking a solder in the form of a platelet to the intermediate silver layer; and subsequently placing a contact carrier on the solder platelet and soldering the contact carrier to the solder platelet.

This order in the production process assures reliable production of the contacts in terms of both the position of the solder platelet and the quality of the soldering operation. At the same time, it makes the production process less expensive.

In accordance with another feature of the invention, prior to the soldering, the solder platelet is located in an indentation in the intermediate silver layer. As a result, in the soldering operation the solder platelet is surrounded by this edge of the intermediate silver layer resting on the contact carrier and cannot escape laterally as easily. This indentation can be produced by a pressing or embossing step.

In accordance with a further feature of the invention, the tacking or provisional fastening of the solder platelet is performed by welding. Ultrasonic welding of the solder platelet to the intermediate silver layer has proved to be especially advantageous, because it avoids heating of the solder platelet. That could otherwise lessen the quality of the later soldering.

In accordance with an added mode of the invention, the solder platelet is pressed onto the intermediate silver layer during the ultrasonic welding through a pressure plate with small dotlike bumps. This provision means that the ultrasonic welding takes place only at the few pressure points of the dotlike bumps, and can accordingly be carried out with very much less exerted pressure and ultrasonic energy. This in turn means that the side of the silver layer toward the solder layer has small indentations at the those points where the dotlike bumps on the pressure plate were located.

In accordance with a concomitant mode of the invention, the solder platelet is pressed flush into the intermediate silver layer prior to the soldering. This creates the prerequisite for completely planar contact with the contact carrier in the later soldering operation. At the same time, because of the thus-produced lateral enclosure of the solder platelet by the intermediate silver layer, lateral outflow of solder upon soldering to the contact carrier is prevented, because the solder is bound into the material of the edge of the intermediate silver layer. This also prevents the solder material from creeping upward at the edges of the silver during soldering. In the final analysis, this operation can replace a separate operation of pre-embossing the intermediate silver layer.

Other features which are considered as characteristic for the invention are set forth in the appended claims.

Although the invention is illustrated and described herein as embodied in a contact with a silver contact base and a process for making the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
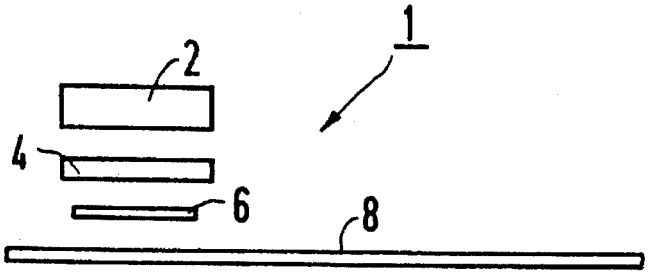
FIG. 1 is an exploded, diagrammatic, front-elevational view of a contact.

Referring now to the figures of the drawing in detail and first, particularly, to FIG. 1 thereof, there is seen an exploded view which shows the structure of a contact 1. The contact 1 includes a silver contact base 2, an intermediate silver layer 4, a solder platelet 6 and a contact bearer or carrier 8. The electrical contact silver or switch silver contact base 2 in the exemplary embodiment is formed of a known silver alloy. In the exemplary embodiment, the silver contact base 2 takes the form of a rectangular plate having the dimensions of a later contact. However, it could equally well take the form of a flat round disk or a hemispherical dome. The intermediate silver layer 4, which can be seen in FIG. 1 under the silver contact base 2, is adapted in its dimensions to the outline of the silver contact base 2. In the exemplary embodiment, the intermediate silver layer 4 is a pure silver. The solder platelet 6 can be seen under the intermediate silver layer 4. The solder platelet is essentially formed of copper and silver and in its commercially available form it already contains all of the required soldering aids. The solder platelet 6 has been cut from a strip of solder of the desired width, which is available commercially. The contour of the solder platelet is adapted to the contour of the intermediate silver layer 4, but the intermediate silver layer protrudes past it on all sides by approximately 1 mm. The contact carrier 8 for the contact 1 is shown in FIG. 1 under the solder platelet 6. The contact carrier is formed of a flat material made of steel that is surface-coated with copper.

Figure 2:
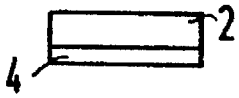
FIG. 2 is a side-elevational view of the two-layer contact.

In the making of the contact 1, the silver contact base 2 is first compressed in a pressing tool with the intermediate silver layer 4 that is cut to the contact size from flat silver material, to make a two-layer contact seen in FIG. 2.

Figure 3:
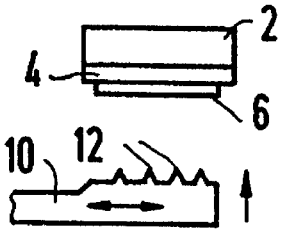
FIG. 3 is a fragmentary, side-elevational view of the two-layer contact after ultrasonic welding of the solder.

As is shown in FIG. 3, the solder platelet 6, which was previously cut from a strip of flat solder material, is placed on the intermediate silver layer 4 of this two-layer contact, it is positioned, and it is tacked or provisionally fastened or welded by ultrasound using a sonotrode 10. The sonotrode 10 has a contact surface facing toward the solder 6 and this surface is provided with small bumps 12. In the exemplary embodiment, the bumps are small pyramidlike points 12 that press the solder platelet 6 against the intermediate silver layer 4. When the piezoelectric ceramic is activated, this pressure surface of the sonotrode 10 vibrates in the direction parallel to the contact surface onto the solder 6. In the process, surface elements of the solder platelet 6 that are located under the conical bumps 12 on the contact surface of the sonotrode 10 and are thus pressed to an increased extent against the intermediate silver layer 4, fuse with the intermediate silver layer, while the solder platelet otherwise remains cold. Alternatively, it would also be possible to tack or provisionally fasten the solder platelet to the intermediate silver layer by gluing, through the use of an organic contact glue. This glue then evaporates in the subsequent soldering operation.

Figure 4:
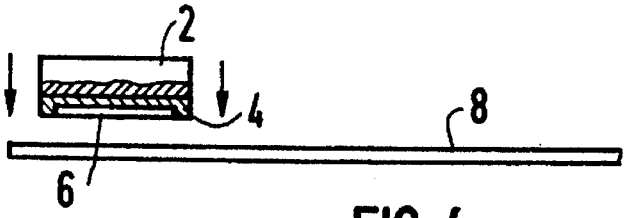
FIG. 4 is a side-elevational view of the finished three-layer contact before soldering onto the contact carrier.

The two-layer contact 2, 4 which is provided with the solder platelet 6 in this way, is then placed underneath a pressing tool and pressed flat with an exerted pressure of several tons per $cm^2$. The solder platelet 6 is thus pressed into the intermediate silver layer 4 as is seen in FIG. 4, so that the intermediate silver layer surrounds the solder platelet on all sides, except for the surface to be soldered later to the contact carrier 8. After the pressing operation, the two-layer contact is placed on the contact carrier 8 and soldered to the contact carrier. To that end, the contact carrier 8 together with the solder platelet 6, the intermediate silver layer 4 and the silver contact base 2 is inductively heated to approximately 750° C. Due to the prior planar pressing, upon soldering, the contact rests entirely flat on the contact carrier 8. As a result, exactly reproducible, uniform conditions prevail over the entire soldering surface. This is a prerequisite for automating the soldering operation and for shortening the inductive heating time to approximately 1 second, without having to fear locally uncontrolled overheating. Moreover, as a consequence of this planar pressing, the solder platelet is pressed into the intermediate silver layer and enclosed on all sides, with the exception of the contact surface, by the intermediate silver layer 4 on the contact carrier 8. As a result, excess solder alloys to the silver edge and is thus prevented from creeping laterally upward onto the silver contact base.

It is a great advantage of this production process that the solder platelets 6 can be positioned reliably on the intermediate silver layer 4 of the silver contact base, without having to be heated beforehand to a temperature near the soldering temperature for that purpose. This avoids the risk that heating of the solder might have disadvantages in later soldering to the contact carrier 8. Moreover, manipulation of the parts is simplified and made less expensive in this way.

Proof of the ultrasonic welding of the solder on the intermediate silver layer can be provided by means of a micrograph.

We claim:

1. A method for making a contact, which comprises:

pressing an intermediate silver layer onto a silver contact base;

then provisionally fastening a solder in the form of a platelet to the intermediate silver layer; and subsequently placing a contact carrier on the solder platelet and soldering the contact carrier to the solder platelet.

2. The method according to claim 1, which comprises carrying out the step of the provisional fastening of the solder platelet by welding.

3. The method according to claim 1, which comprises carrying out the step of the provisional fastening of the solder platelet by ultrasonic welding to the intermediate silver layer.

4. The method according to claim 1, which comprises carrying out the step of the provisional fastening of the solder platelet by gluing.

5. The method according to claim 3, which comprises pressing the solder platelet onto the intermediate silver layer during the ultrasonic welding with a pressure plate having small dotlike bumps.

6. The method according to claim 3, which comprises pressing the solder platelet onto the intermediate silver layer during the ultrasonic welding with a pressure plate having small, conical, dotlike bumps.

7. The method according to claim 5, which comprises vibrating the pressure plate with ultrasonic vibrations being oriented at a tangent to a contact surface of the solder platelet.

8. The method according to claim 6, which comprises vibrating the pressure plate with ultrasonic vibrations being oriented at a tangent to a contact surface of the solder platelet.

9. The method according to claim 1, which comprises pressing the solder platelet flush into the intermediate silver layer prior to the soldering.

10. The method according to claim 1, which comprises inductively heating the contact carrier, the solder platelet, the intermediate silver layer and the silver contact base in the soldering operation.

11. The method according to claim 1, which comprises, in the pressing step, selecting a silver contact base formed of a silver alloy and selecting an intermediate layer formed of pure silver.

* * * * *